US006976939B2

(12) United States Patent
Harker et al.

(10) Patent No.: US 6,976,939 B2
(45) Date of Patent: Dec. 20, 2005

(54) EXERCISE DEVICE FOR LOWER BODY

(76) Inventors: Verla D. Harker, 8946 Fm 250 North, Naples, TX (US) 75568; Fred R. Harker, 8946 Fm 250 North, Naples, TX (US) 75568

( * ) Notice: Subject to any disclaimer, the term of this patent is extended or adjusted under 35 U.S.C. 154(b) by 0 days.

(21) Appl. No.: 10/765,113

(22) Filed: Jan. 28, 2004

(65) Prior Publication Data

US 2005/0164836 A1 Jul. 28, 2005

(51) Int. Cl.[7] ..... A63B 22/04
(52) U.S. Cl. ..... 482/52
(58) Field of Search ..... 482/51–53, 75, 482/77, 79, 80, 148, 121–123, 127–130, 482/133, 135, 139

(56) References Cited

U.S. PATENT DOCUMENTS

| | | | | |
|---|---|---|---|---|
| 3,295,847 A | | 1/1967 | Matt, Sr. | |
| 3,628,791 A | | 12/1971 | Garcia | |
| 3,638,940 A | | 2/1972 | Mehaulic | |
| 3,814,420 A | | 6/1974 | Encke | |
| 3,929,329 A | | 12/1975 | Rivera | |
| 4,200,282 A | | 4/1980 | Agyagos | |
| 4,279,415 A | * | 7/1981 | Katz | 482/80 |
| 4,645,197 A | | 2/1987 | McFee | |
| 4,705,028 A | * | 11/1987 | Melby | 482/51 |
| RE34,959 E | | 5/1995 | Potts | |
| 5,507,708 A | * | 4/1996 | Ma | 482/52 |
| 5,755,651 A | * | 5/1998 | Homyonfer et al. | 482/146 |
| 6,132,338 A | | 10/2000 | Shifferaw | |
| 6,572,514 B1 | * | 6/2003 | Calafato | 482/79 |
| 6,761,666 B2 | * | 7/2004 | Chou | 482/52 |

FOREIGN PATENT DOCUMENTS

GB 1348531 3/1974

* cited by examiner

*Primary Examiner*—Stephen R. Crow
*Assistant Examiner*—Tam Nguyen
(74) *Attorney, Agent, or Firm*—Richard C. Litman

(57) ABSTRACT

An exercise device for lower body includes a housing defining two compartments, a tread positioned within each compartment, and compression spring assemblies positioned within each compartment. Each tread is supported by and floats on top of its compression spring assembly.

8 Claims, 3 Drawing Sheets

EXERCISE DEVICE FOR LOWER BODY

BACKGROUND OF THE INVENTION

1. Field of the Invention

The present invention relates to exercise equipment. More particularly, exercise equipment of the type that a person can stand upon and work his or her lower body by engaging his or her feet with a pair of upwardly spring-biased treads.

2. Description of the Related Art

Exercise equipment is known that, to varying extents, satisfy important countervailing requirements. The most important requirements are (1) it must safely and effectively work at least one of the major muscle groups, isolated muscles, or the cardiovascular system, and (2) it must be fun and enjoyable. Exercise equipment that cannot satisfy these two basic requirements, while at the same time tertiary goals of being sturdy, reliable, convenient, inexpensive, and simple to use, will not be successful. For example, free weights achieve many of these goals, but without additional specialized equipment, they have limited application and can be dangerous if not used appropriately and/or without a spotter. Free weights are generally only useful in developing and exercising the upper body.

Lower body exercise has many medically important benefits including lower body weight, decreased risk of diseases such as diabetes, heart disease, and some cancers, lower body fat, improved physical appearance, reduced instances of depression, reduced symptoms of menopause, improved bladder control, reduced risk of injury, improved cholesterol levels, more positive self-esteem, better sleeping patterns, more energy & stamina, and many others. It is not a matter of debate that lower body workouts exercising the largest muscles in the body, aerobically stressing the cardiovascular system, and testing balance and coordination contribute greatly to physical and mental well-being.

For cardiovascular, calorie-burning, and lower-body workouts, well known devices include the stationary bicycle, the treadmill, the ski-machine, the stair-climber (e.g., Reissued U.S. Pat. No. Re. 34,959, issued May 30, 1995 to Potts), the elliptical machine, and many other similar devices. These devices are effective, but are expensive and take up a great deal of floor space; they are not very convenient. Because some of these devices such as the treadmill and the stair-climber cannot provide a low-impact workout, they can exacerbate joint and spine problems, and be painful to those sensitive to high impact workouts.

Known devices include exercise trampolines, ones that are about 3 feet (1 meter) in diameter and sit 8 to 10 inches (20–25 cm) off the floor, are inexpensive and can provide a relatively good low-impact lower-body workout, but they are too soft and result in too much bounce and not enough resistance. Furthermore, they take up a large amount of floor space and can be difficult to store when not in use, e.g., they generally will not fit into a closet.

In recognition that there exists a need for a simple, compact, low-impact lower-body exercise device, a number of patents have issued disclosing devices attempting to fill this need.

For example, U.S. Pat. No. 4,279,415, issued Jul. 21, 1981 to Katz, discloses a treadle exercise device comprising a pair of hinged pedals (treadles) biased upwardly by a pair of springs and blown or cellular polyurethane foam. Like many spring-biased treadle devices, the hinge of the Katz device is located behind the foot. This causes the user to either stand on his or her toes when stepping down on the treadle which can excessively strain the ankle, or overstretch the ankle (Achilles) tendon. Similar devices include those disclosed in U.S. Pat. No. 3,814,420, issued Jun. 4, 1974 to Encke; U.S. Pat. No. 3,638,940, issued Feb. 1, 1972 to Mehaulic; U.S. Pat. No. 3,628,791, issued Dec. 21, 1971 to Garcia; and U.S. Pat. No. 3,295,847, issued Jan. 3, 1967 to Matt, Sr.

Another type of device, shown by U.S. Pat. No. 4,645,197, issued Feb. 24, 1987 to McFee, describes an exercise device having a biased platform hinged at a position in front of the foot. The platform is adjusted so that the springs provide just sufficient energy to maintain the user at about mid-position when quiescent. The springs are pre-stressed and provide nearly constant force through the full range of motion of the platform. A shock absorber connected to the platform dissipates energy. In use, the overall action of the body is described as "not unlike swimming doing the breast stroke with a porpoise kick" (McFee, col. 6, lines 57–59). This device takes up a great deal of floor space, is complicated to set up and use, and is not easy to store.

U.S. Pat. No. 6,132,338, issued Oct. 17, 2000 to Shifferaw and U.S. Pat. No. 4,200,282, issued Apr. 29, 1980 to Agyagos, and U.K. Patent Specification U.S. Pat. No. 1,348,531, published Mar. 20, 1974 for Wheeler each show variations on a "bounce board" which include a spring biased or flexible platform for exercise or fun. The U.S. patent to Shifferaw may mar the floor or damage carpeting due to movement of the feet when the board is flexed. A danger exists with the Shifferaw and Wheeler devices that they may jump or move during use. The Agyagos device's platform has a very restricted range of movement and is hinged at one end very close to the heel which requires user to therefore stand and jump on his or her toes.

U.S. Pat. No. 3,929,329, issued Dec. 30, 1975 to Rivera discloses spring supported ski-boot bindings for testing out the feel of a pair of ski boots. This device is not designed to exercise the individual and relies on the stiffness of the ski boots to prevent it from unwanted tilting and wobbling. It is not practical for daily workouts.

None of the above inventions and patents, taken either singly or in combination, is seen to describe the instant invention as claimed. Thus, an exercise device for lower body solving the aforementioned problems is desired.

SUMMARY OF THE INVENTION

The invention is an exercise device for the lower body, and includes a housing defining two compartments, a tread positioned within each compartment, and a compression spring assembly positioned within each compartment. Each tread is supported by and floats on top of its springs.

Accordingly, it is a principal object of the invention to provide an exercise device that provides a good workout, is simple and fun to use, and is compact, reliable, convenient, inexpensive, and sturdy.

It is another object of the invention to provide an exercise device that works the lower body and generates health benefits including one or more of: reduced body weight; decreased risk of diseases such as diabetes, heart disease, and some cancers; lower body fat; improved physical appearance; reduced instances of depression; reduced symptoms of menopause; improved bladder control; reduced risk of injury; improved cholesterol levels; more positive self-esteem; better sleeping patterns; and more energy & stamina.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENT

Figure 1:
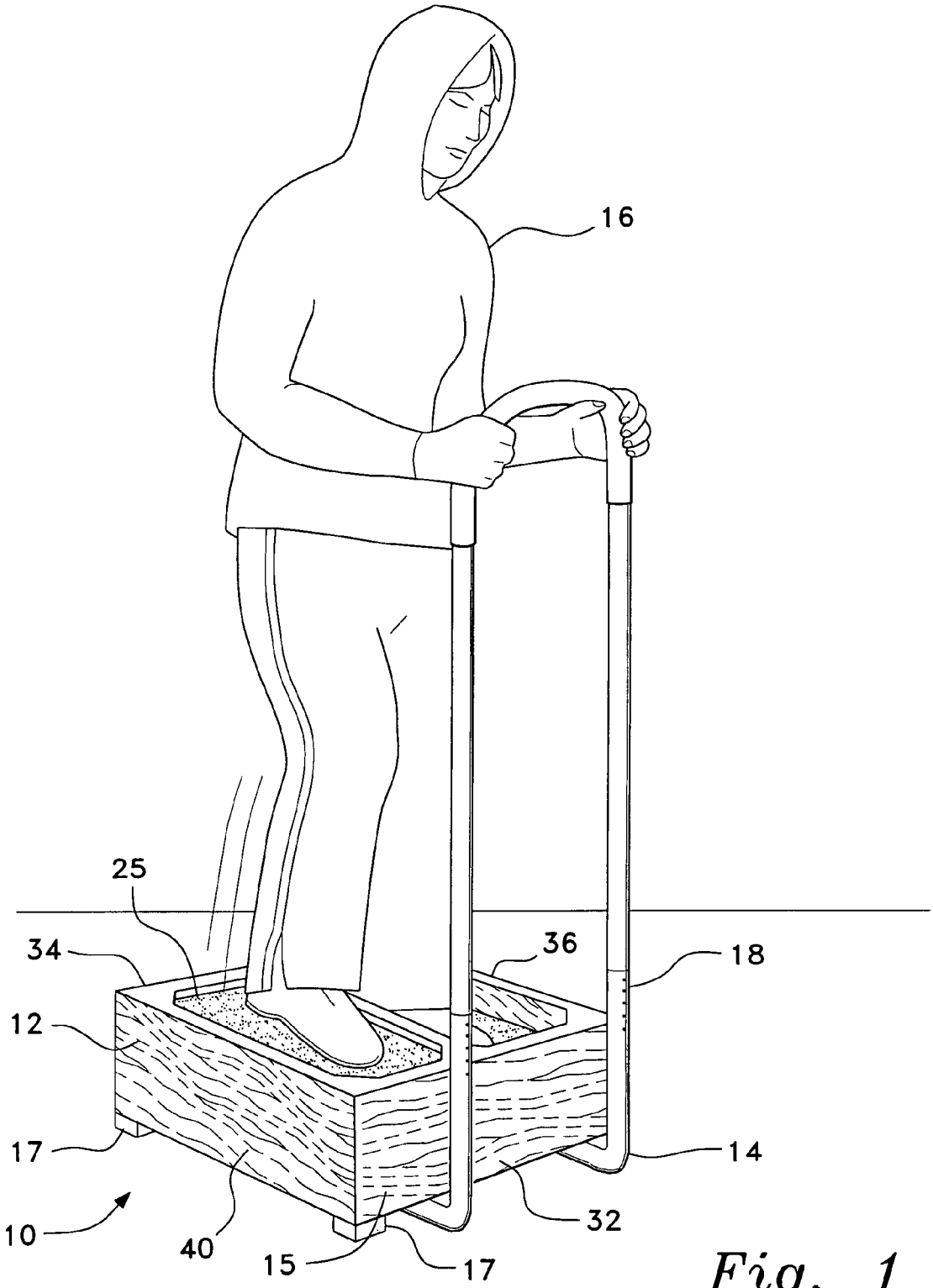
FIG. 1 is an environmental, perspective view of an exercise device for the lower body, in accordance with the present invention.

A lower body exercise device 10 according to the present invention is shown in FIG. 1. Lower body exercise device 10 includes a housing 12 and handle 14 extending up from a front end 15 of housing 12 to a position within easy reach of a person 16 standing on treads 25 of housing 12. Housing 12 is supported by four feet 17, two of which are seen in FIG. 1.

Figure 2:
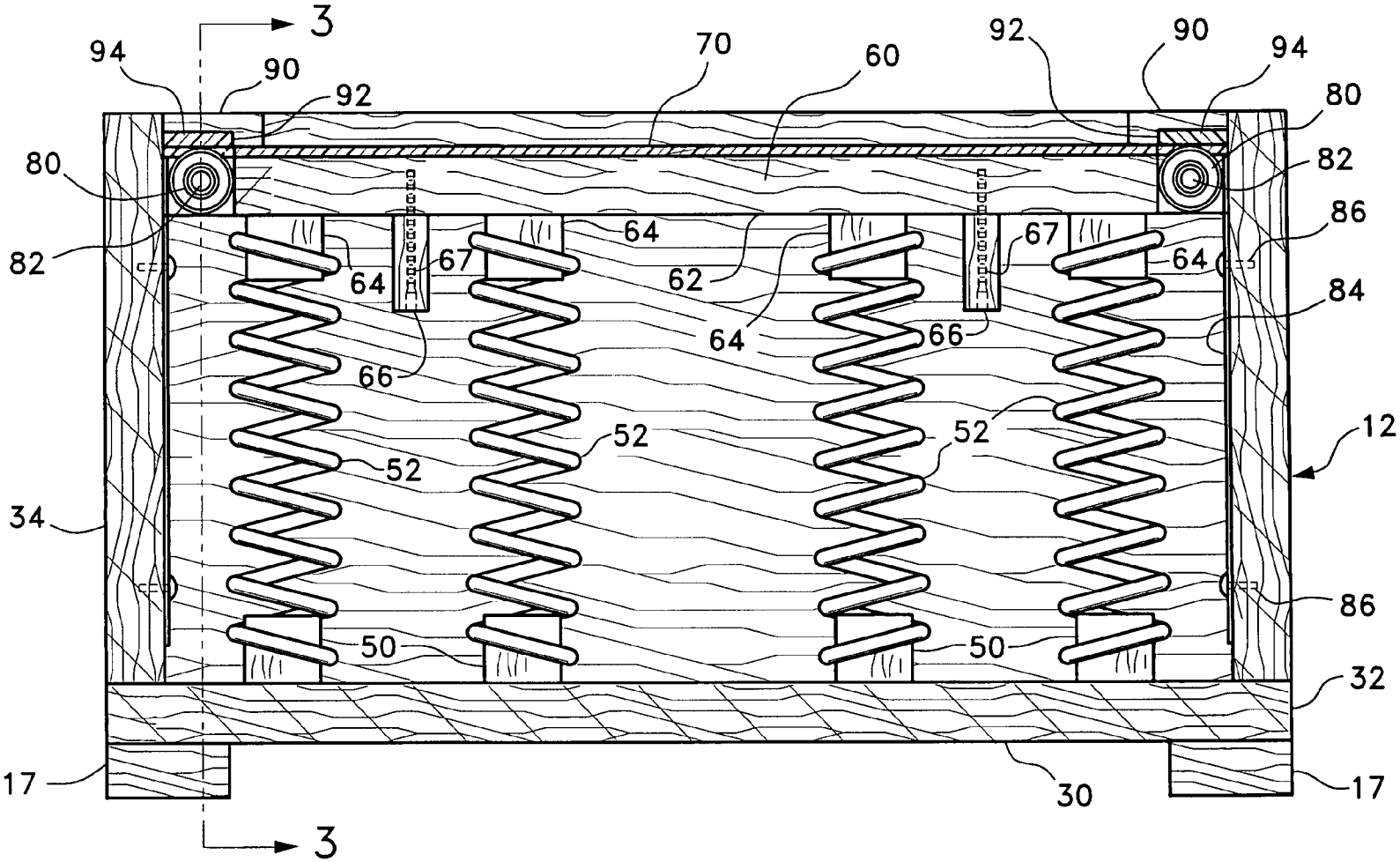
FIG. 2 is a sectional view taken along lines 2—2 of FIG. 3.
Figure 3:
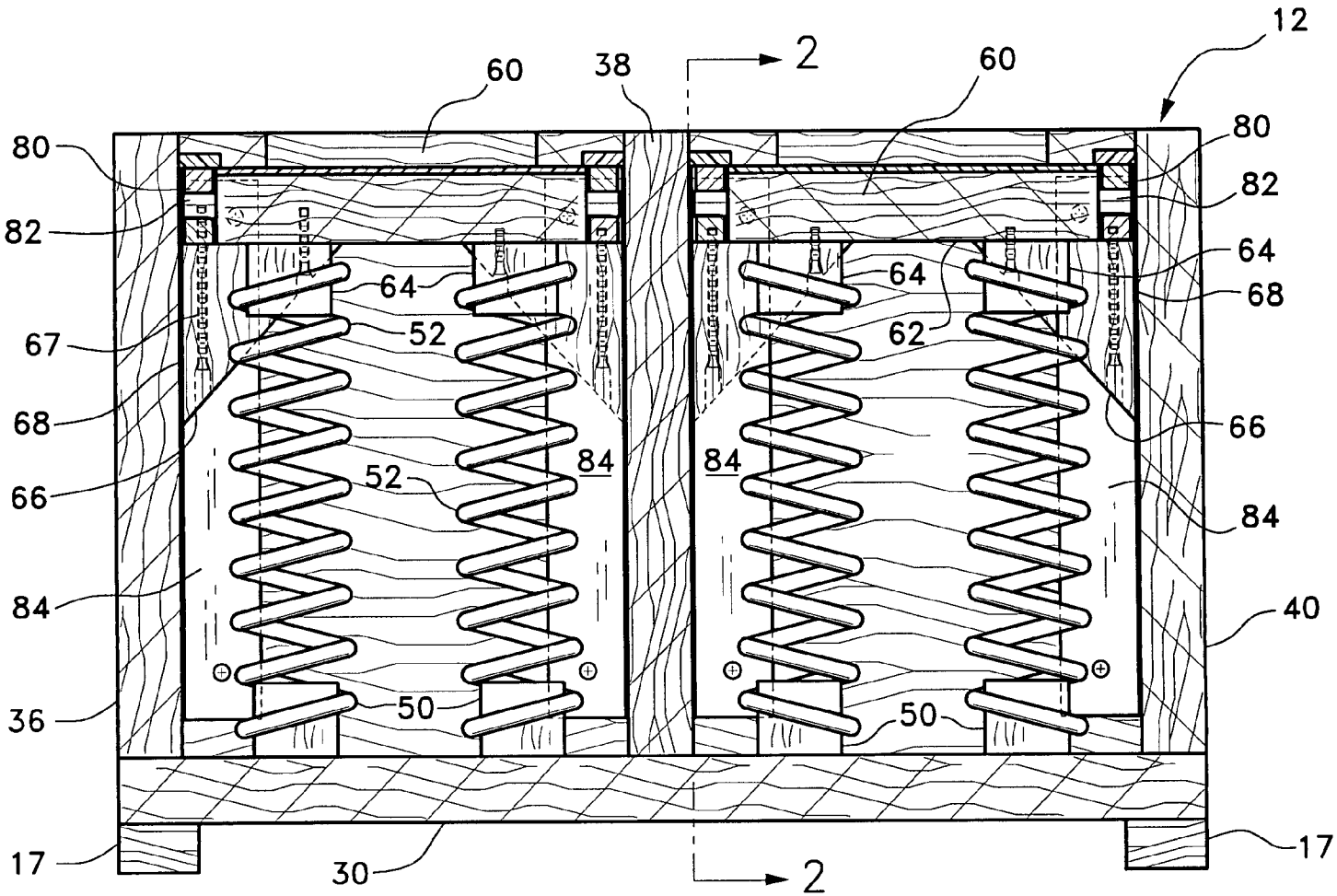
FIG. 3 is a sectional view taken along lines 3—3 of FIG. 2.

The structural details of exercise device 10 will now be discussed with reference to FIGS. 2 and 3, which are provided for illustrative purposes only and are not drawn to scale. Housing 12 includes a front panel 32, a back panel 34, a left panel 36, a middle panel 38, and a right panel 40 (collectively, "panels 32–40"), which collectively define two hollow compartments. Panels 32–40 are fixed to bottom panel 30. In the case that panels 32–40 and bottom are made of wood, any known fasteners for attaching the panels as shown and described, including glue, dove-tail, screws, nails, biscuits, tongue-in-groove, etc., and combinations thereof, are contemplated. Other materials for construction are contemplated, including laminates, high-impact plastic, and other moldable or workable materials including metal. Any of panels 32–40 and bottom panel 30 can be produced as a single contiguous molded part without departing from the spirit and scope of the invention.

Housing 12 is made of three-quarter inch thick wood and stands, including feet, less than nine inches off the floor. Housing 12 is less than 20 inches long and about 17 inches wide. These dimensions are for illustrative purposes only; other dimensions and materials are of course contemplated.

Bottom panel 30 includes a plurality of raised cylindrical spring anchors 50. Each spring anchor 50 may be embodied as a dowel screwed or otherwise attached to bottom panel 30. Alternatively, if bottom panel 30 is made of molded material, spring anchors 50 may be formed integrally therewith.

Rather than raised cylindrical spring anchors 50, they may be formed as recesses (not shown) formed in bottom panel 30. For example, a blind hole having a diameter at least slightly smaller than the outside diameter of springs 52 for a force-fit may be drilled partway into bottom panel 30.

A compression spring 52 is positioned on each anchor 50. Each spring has an outside diameter of about 1.8 inches (4.6 cm) and a free length of about 6.0 inches (15 cm).

Springs 52 preferably are coated in an elastomeric material to reduce vibration noise. For example, springs 52 may be dipped in elastomeric material which is then allowed to cure. Suitable elastomeric material is available commercially from Plasti Dip International of Blaine, Minn. and sold under the trade name "PERFORMIX BRAND PLASTI DIP".

A tread 60 is provided on a left side and a right side of center panel 38. Each tread 60 is positioned for a respective foot of person 16 (FIG. 1) using the device. Each tread bottom 62 includes a plurality of spring anchors 64 opposite spring anchors 50. In the exemplary embodiment shown in FIGS. 2–4, tread 60 is formed from wood, though any suitable rigid material would suffice. As discussed above with respect to bottom panel 30, spring anchors 64 may be formed as raised cylinders formed on tread bottom 62 or blind holes. In the exemplary embodiment, spring anchors 64 are provided by short cylindrical dowels fixed to tread bottom 62.

Tread bottom 62 also includes stabilizers 66. Stabilizers 66 are triangular or wedge-shaped pieces anchored to the tread bottom 62 using screws 67, although other means of attaching stabilizers 66 to tread bottom 62 are of course contemplated. Stabilizers 66 and spring anchors 64 may be formed contiguously with tread 60 in the case where tread 60 is formed of moldable or workable material.

Sides 68 of stabilizers 66 slide along left and right side panels 36, 40, and middle panel 38, and help stabilize tread 60. Stabilizers 66 therefore prevent lateral roll, or side-to-side tilting, of tread 60. In addition, sides 68 are coated or covered with a low-friction material. In the case where wedges 66 and sides 36, 40 and middle panel 38 are wood, a suitable low-friction material is ordinary household wax. Other exemplary materials include PTFE (polytetrafluoroethylene) or acetal resin (such as that sold under the tradenames "TEFLON" and "DELRIN", respectively, by DuPont of Wilmington, Del.). In addition or in place of a low-friction coating, a lubricant such as grease, wax or graphite may be used to reduce friction. Alternatively, rollers or other similar structure may be used to reduce friction between stabilizers 66 and side panels 36, 40 and middle panel 38.

While the exemplary embodiment shows triangular-shaped stabilizers 66, other shapes are of course contemplated. Quarter-circles, square blocks, an angle bracket, or simply a pair of beams extending entirely across tread bottom 62 are all contemplated. The number of stabilizers 66 may also be varied provided that at least one side 68 is on each side of tread 60 to prevent lateral roll with respect to housing 12.

To reduce friction and noise generated by relative movement of tread 60 along the front and back panels 32, 34, rollers 80 are provided at each corner of tread 60. Each roller 80 is positioned over a pin or dowel 82. Rollers 80 are preferably made of metal or some low-friction resin material. A wear surface 84 is attached at either side of each tread 60 to front panel 32 and back panel 34 so that each wear surface 84 is positioned for contact with a corresponding roller 80. Wear surfaces 84 may be formed of metal or plastic, and are attached by screws 86 or other means as would occur to the ordinary practitioner. Wear surfaces 84 are helpful in protecting front and back panels 32, 34, particularly when they are made of wood, as in the exemplary embodiment shown, or other material susceptible to wear. For other materials, wear surfaces 84 may be integral to the front and back panels 32, 34.

Each tread 60 may include a friction pad 70 to improve the friction between tread 60 and a user's foot. Friction pad 70 may comprise a textured rubber mat of the type used in treadmills. Other known means for enhancing friction of treads 60 are contemplated. For example, friction enhancers could include a textured surface of each tread 60.

Stops 90 prevent treads 60 from popping out of housing 12. In the exemplary embodiment, stops 90 are made of half-inch (1.3 cm) wood and are attached to front, side and middle panels of housing 12 at the top corners of each compartment. Each stop 90 includes an elastomeric stop 94 positioned in groove 92 formed in the bottom of the stop. Each elastomeric stop 94 engages a corresponding roller 80 at the same time friction pad 70 engages stops 90. Elastomeric stops 94 reduce noise generated when a tread 60 travels up and engages stops 90.

Springs 52 are compressed only about one quarter inch (0.6 cm) from free length when tread 60 engages stops 90. Springs 52 are quite stiff and provide a strong return force when deflected. In the exemplary embodiment, spring rate of each tread 60 is about 156 pounds per inch (273 N/cm) of deflection. Thus, a 156 pound person, when placing all his or her weight on one tread 60 will sink only about 1 inch. In the exemplary embodiment of FIGS. 2 and 3, each tread 60 is supported by eight springs. To obtain the spring rate noted above, four springs with a spring rate of 15.7 lbs/in (27.5 N/cm) and four springs with a spring rate of 23.4 lbs/in (41.0 N/cm) may be employed. To improve pitch stability, i.e., the tendency for treads 60 to pitch forward or back, the more rigid springs are placed at the front and back of tread 60 with the softer springs positioned in the more central locations. Six inch long springs with the above spring rates are commercially available; Diamond Wire Spring Company of Pittsburgh, Pa. produce and stock suitable springs having the spring rates mentioned above. Obviously, more springs with a smaller spring rate or fewer springs with a higher spring rate will achieve similar results. As mentioned earlier, each spring is preferably coated with an elastomer to reduce noise generated from spring vibrations.

Because treads 60 are not attached in any way to housing 12, they "float" on springs 52, and can tilt slightly forward and back in response to more weight being placed toward the front or back of the tread. This accommodates a person's natural stride; if an exerciser comes down on his or her heels, the treads 60 will respond and distribute the weight across the person's entire foot. This reduces the possibility for injury or discomfort that prior art devices can cause if used regularly.

The exemplary embodiment presents coiled compression springs for providing a return force to treads 60. However, other types of springs are contemplated. For example, leaf-springs, torsion springs, and various other known springs shapes are all contemplated and easily integrated into housing 12.

It is to be understood that the present invention is not limited to the embodiments described above, but encompasses any and all embodiments within the scope of the following claims.

We claim:

1. An exercise device for lower body, comprising:

a housing defining two compartments;

a tread positioned within each compartment of said two compartments, each said compartment including two side walls to the left and right of said tread, each said tread including stabilizing means to limit lateral roll of said tread, said stabilizing means including a surface fixed to said tread and located on each side of said tread, each said surface engaging a respective one of said side walls, thereby limiting lateral roll of said tread, wherein said surface includes friction reducing means; and spring means positioned within each said compartment supporting said tread, said tread thereby floating on said spring means.

2. The exercise device of claim 1 wherein said spring means comprise a plurality of coiled compression springs.

3. The exercise device of claim 2 wherein said housing comprises a bottom panel, said bottom panel includes spring anchors and said tread includes a bottom surface which includes spring anchors, each said plurality of compression springs being anchored between a spring anchor on said bottom panel and a spring anchor on said bottom surface.

4. The exercise device of claim 3 wherein each spring anchor comprises a raised cylinder around which an end of one of said compression springs extends.

5. An exercise device for lower body, comprising:

a housing defining two compartments;

a tread positioned within each compartment of said two compartments, wherein each said compartment includes a front and back wall, and each said tread includes two front rollers positioned at a front of said tread and two back rollers positioned at a back of said tread, said front rollers engaging said front wall and said back rollers engaging said back wall; and spring means positioned within each said compartment supporting said tread, said tread thereby floating on said spring means.

6. The exercise device of claim 5 wherein said front wall and said back wall include wear plates at locations contacted by said front rollers and said back rollers.

7. The exercise device of claim 1 further comprising a handle, the handle extending up from said housing and providing a rail positioned to be gripped by a person using said exercise device.

8. An exercise device comprising:

a housing;

a first tread and a second tread positioned within said housing;

spring means positioned within said housing supporting said first tread and said second tread, said spring means forcing said first tread and said second tread toward a top of said housing, said first tread and said second tread being supported by said spring means; and guide means for allowing said first tread and said second tread to translate vertically within said housing, wherein said guide means comprise a plurality of rollers to reduce friction between said first tread and said second tread and said housing.

* * * * *